US009334880B1

(12) United States Patent
Christensen

(10) Patent No.: US 9,334,880 B1
(45) Date of Patent: May 10, 2016

(54) REVERSIBLE INLINE JET SIPHON

(75) Inventor: Jan W. Christensen, Rock Island, IL (US)

(73) Assignee: FOL-DA-TANK COMPANY, Milan, IL (US)

( * ) Notice: Subject to any disclaimer, the term of this patent is extended or adjusted under 35 U.S.C. 154(b) by 0 days.

(21) Appl. No.: 13/537,167

(22) Filed: Jun. 29, 2012

Related U.S. Application Data

(63) Continuation-in-part of application No. 13/331,531, filed on Dec. 20, 2011.

(51) Int. Cl.
*F04F 5/44* (2006.01)
*F04F 5/46* (2006.01)

(52) U.S. Cl.
CPC .. *F04F 5/44* (2013.01); *F04F 5/461* (2013.01)

(58) Field of Classification Search
CPC ..... F04F 5/461; F04F 5/464; F04F 5/44
USPC ..... 417/181, 151, 183, 187
See application file for complete search history.

(56) References Cited

U.S. PATENT DOCUMENTS 1,484,345 A * 2/1924 Stoelting ..... 417/151
2,757,046 A * 7/1956 Holmes ..... 239/230
2,980,125 A * 4/1961 Grant et al. ..... 137/68.14
3,397,863 A * 8/1968 Bell ..... 251/285
3,515,502 A * 6/1970 Coordes ..... 417/178
3,884,373 A * 5/1975 Archibald ..... 406/137
4,208,172 A * 6/1980 Dill ..... 417/171
4,407,237 A * 10/1983 Merritt, Jr. ..... 122/390
5,797,421 A * 8/1998 Merrett ..... 137/236.1
5,806,599 A 9/1998 Hisaw et al.
6,367,119 B1 4/2002 Jou
6,382,321 B1 5/2002 Bates et al.
6,520,178 B1 * 2/2003 Baker ..... 128/202.27
6,543,534 B2 4/2003 Erick
6,848,681 B2 * 2/2005 Washington et al. ..... 261/76
7,077,207 B2 7/2006 Stark et al.
7,156,119 B2 * 1/2007 Freudendahl ..... 137/68.14
7,909,089 B2 3/2011 Jackson
2004/0046047 A1 * 3/2004 Townsend ..... 239/242
2007/0114038 A1 5/2007 Daniels et al.
2011/0011951 A1 1/2011 Lofthouse

* cited by examiner

*Primary Examiner* — Charles Freay
*Assistant Examiner* — Lilya Pekarskaya
(74) *Attorney, Agent, or Firm* — Shlesinger, Arkwright & Garvey LLP

(57) ABSTRACT

An inline jet siphon comprises a hollow body for connecting inline of a hose, the body including a through opening for passing liquid therethrough; a jet nozzle including a discharge opening disposed within the body, the discharge opening for being disposed in a direction axially of the through opening; and a handle operably connected to the nozzle, the handle being operably associated with the nozzle to reverse the direction of the discharge opening.

25 Claims, 4 Drawing Sheets

REVERSIBLE INLINE JET SIPHON

RELATED APPLICATION

This is a continuation-in-part application of application Ser. No. 13/331,531, filed on Dec. 20, 2011, the priority benefit of which is hereby claimed.

FIELD OF THE INVENTION

The present invention generally relates to pumps and in particular to a siphon device that assists in pumping liquids or slurries.

BACKGROUND OF THE INVENTION

During a firefighting activity, temporary storage tanks are generally setup on site to provide a steady source of water. Tanker trucks are generally used to fill the storage tanks. The rate of filling the storage tanks are dependent on the capacity of the pumps in the tanker trucks. When the temporary storage tanks are set up at some distance from the tanker trucks, the length of the hose from the truck to the storage tanks can cause a decline in the power of the pumps, thereby causing some delay in filling up the storage tanks.

SUMMARY OF THE INVENTION

The present invention provides an inline jet siphon, comprising a hollow body for connecting inline of a hose, the body including a through opening for passing liquid therethrough; a jet nozzle including a discharge opening disposed within the body, the discharge opening for being disposed in a direction axially of the through opening; and a handle operably connected to the nozzle, the handle being operably associated with the nozzle to reverse the direction of the discharge opening.

The present invention further provides an inline jet siphon, comprising a hollow body for connecting inline of a hose, the body including a through opening for passing liquid therethrough; and a jet nozzle including a discharge opening disposed within the body, the discharge opening for being disposed in a direction axially of the through opening. The nozzle is movable such that the discharge opening is oriented from one direction to another opposite direction. An indicator is provided to indicate the direction of the discharge opening.

The present invention provides an inline jet siphon, comprising a hollow body for connecting inline of a hose, the body including a through opening for passing liquid therethrough; and a jet nozzle having a discharge opening disposed within the body, the discharge opening for being disposed in a direction axially of the through opening. The nozzle is L-shaped having a horizontal portion and a vertical portion, the horizontal portion including the discharge opening; the vertical portion is movable such that the discharge opening is oriented to a first or second direction; the vertical portion extending through a wall of the body. A lock is operably associated with the vertical portion to lock the horizontal portion in the first or second position.

DETAILED DESCRIPTION OF THE INVENTION

Figure 1:
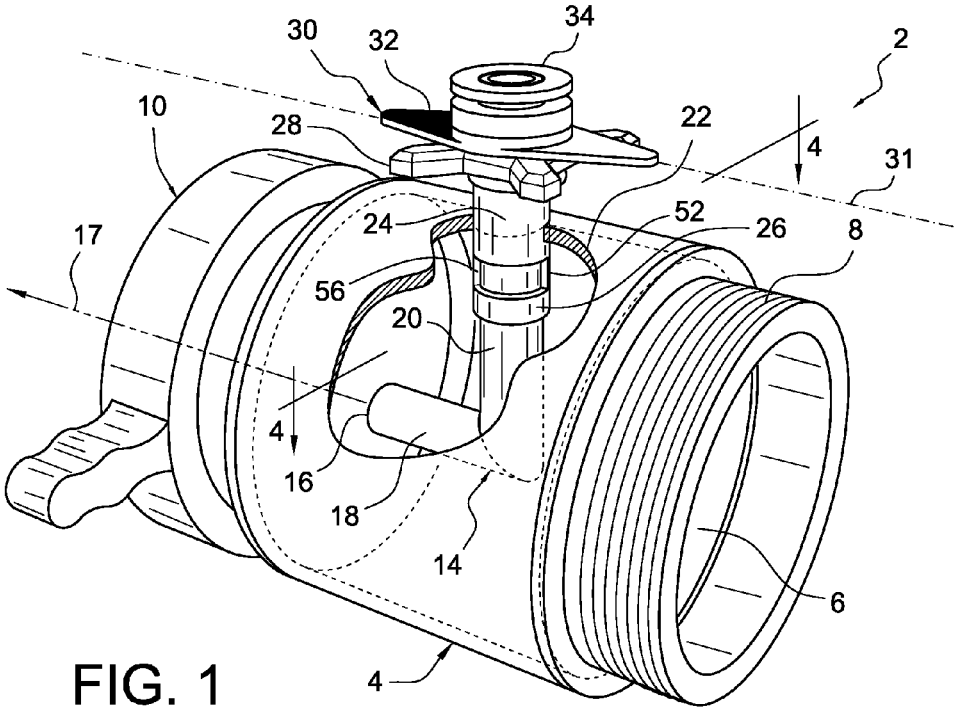
FIG. 1 is a perspective view of an inline jet siphon embodying the present invention and showing a jet nozzle directed toward one direction.
Figure 2:
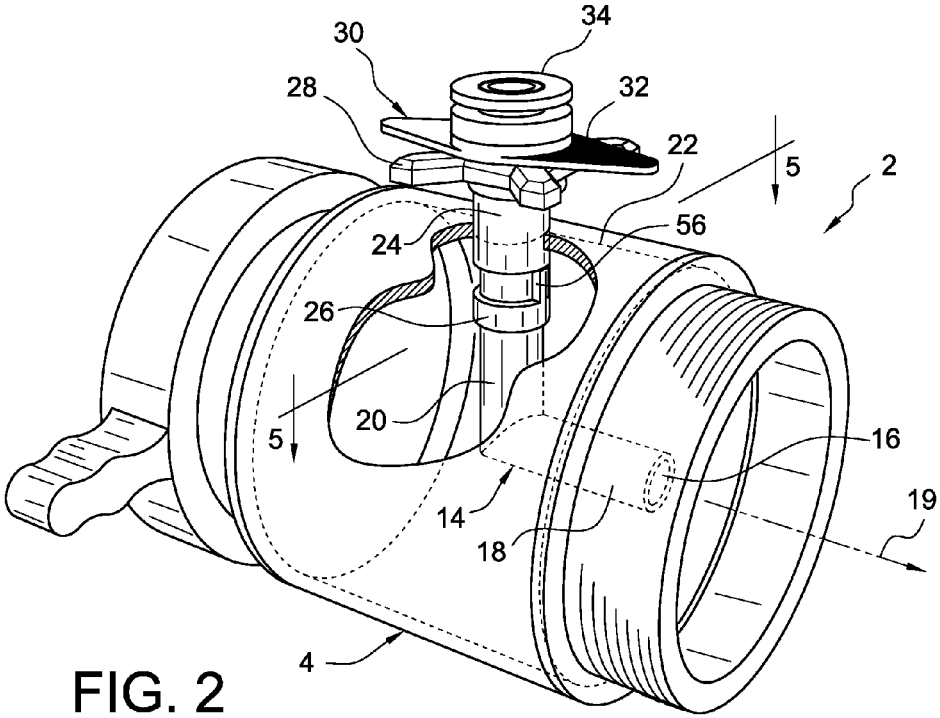
FIG. 2 is a perspective view of the inline jet siphon of FIG. 1, showing the jet nozzle directed in the opposite direction.

An inline jet siphon 2 embodying the present invention is disclosed in FIGS. 1 and 2. The siphon 2 includes a hollow body 4 having a through opening 6 for passing liquid or slurry therethrough. The body 4 is preferably cylindrical, but may be of any shape. The body 4 has male threads 8 at one end and a swivel 10 with female threads 12 at the other end (see FIG. 3). The threads 8 and 12 are used for connecting the body 4 inline of a hose (not shown).

A jet nozzle 14 is disposed within the body 4. The nozzle 14 has a discharge opening 16 with an exit direction 17 or 19 preferably parallel to an axis of the through opening 6. The discharge opening 16 may be positioned in the direction 17 towards one end of the body 4, as shown in FIG. 1, or in the opposite direction 19 towards the other end of the body 4, as shown in FIG. 2.

The jet nozzle 14 includes a horizontal portion 18 and a vertical portion 20, preferably L-shaped. The horizontal portion 18 is preferably aligned with the exit directions 17 and 19. The vertical portion 20 extends through a wall 22 of the body 4 via a sleeve or pivot guide 24, which is fixedly attached to the wall 22. The vertical portion 22 is pivotable within the pivot guide 24. A pivot stop 26 is fixedly attached to the vertical portion 20 and allows the nozzle 14 to be accurately positioned in one of directions 17 and 19.

A lock 28 secures in place the nozzle 14 in one of the two directions 17 and 19. A handle 30 is fixedly attached to the vertical portion 20 to provide turning of the nozzle 14 to point the discharge opening 16 in one the desired directions 17 and 19. The handle 30 preferably provides an indication to the user of the directional position of the discharge opening 16 within the body 4. The handle 30 is preferably longitudinal with a longitudinal axis 31 substantially parallel to the exit directions 17 and 19 and functions as a direction indicator. The handle 30 may take other shapes that include a pointer that points to the direction of the discharge opening 16. One end of the handle 30 aligned with the axis 31 is marked with a color 32 or other standard marking or label to indicate the direction at which the discharge opening 16 is positioned.

A connector 34 is provided to connect a source of high pressure water or compressed air to the nozzle 14.

Figure 3:
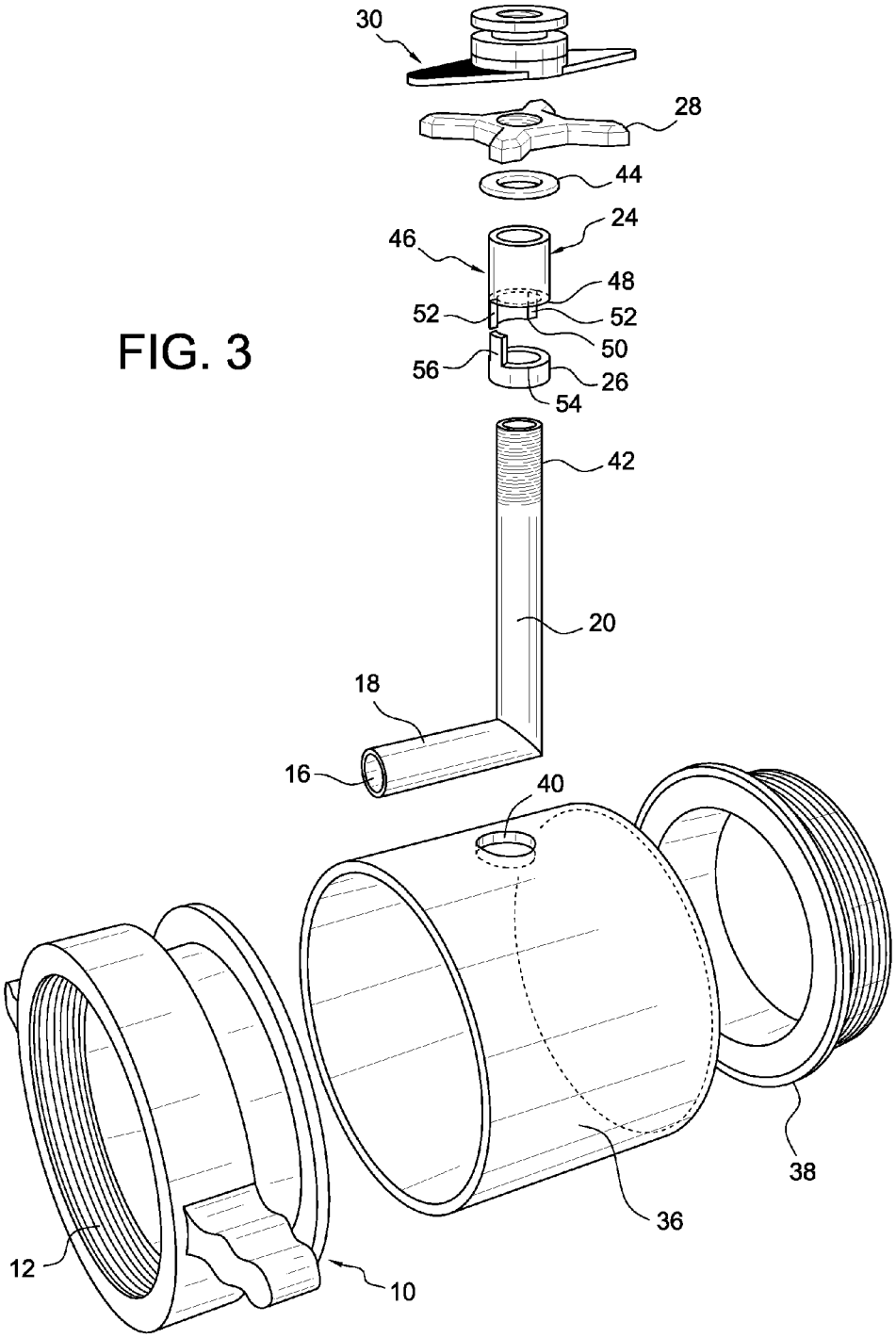
FIG. 3 is an assembly view of the inline jet siphon of FIG. 1.
Figure 4:
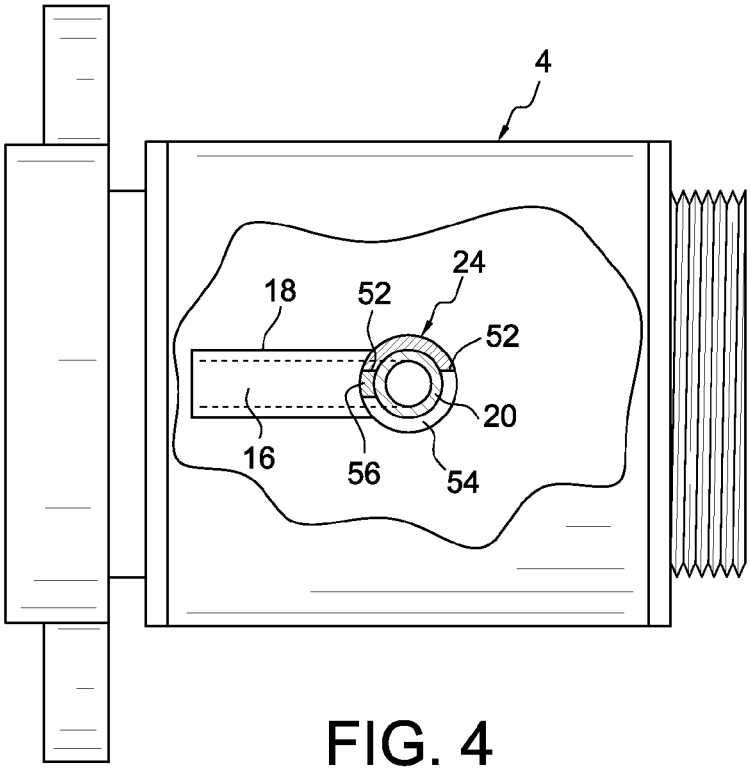
FIG. 4 is a cross-sectional view taken along line 4-4 of FIG. 1.
Figure 5:
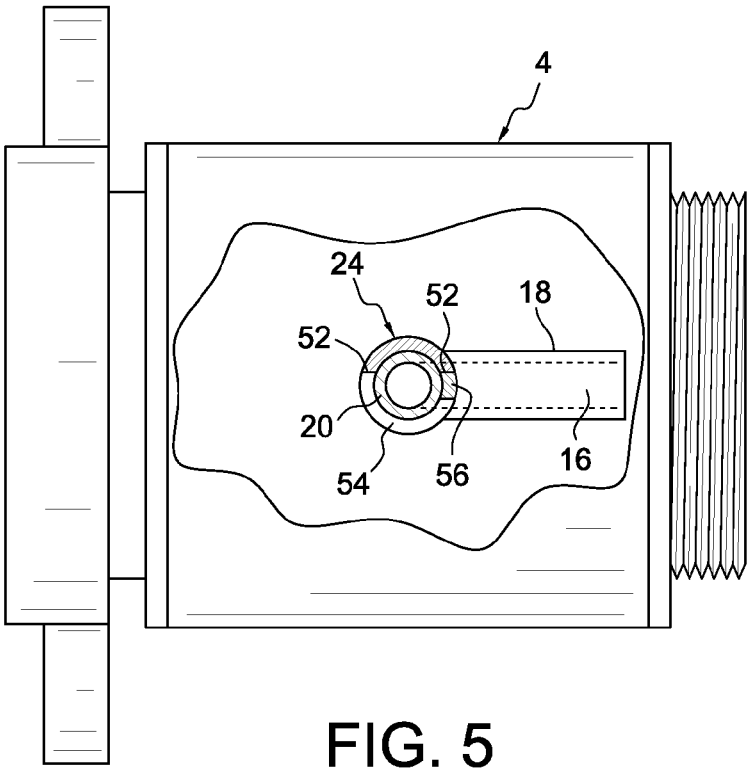
FIG. 5 is a cross-sectional view taken along line 5-5 of FIG. 2.

Referring to FIG. 3, the body 4 may be made from a cylindrical tube 36 joined to a male flange connection 38 and a swivel 10 by welding or other standard means. The cylindrical tube 36 forms an intermediate portion of the body 4. The body 4, the flange connection 38 and the swivel 10 may be made of metal or materials, such as plastic. The body 4 may also be cast in one piece to include the male flange connection 38 and the swivel 10.

The pivot guide 24 is attached in a hole 40 in the cylindrical tube 36 by welding or other standard means. The pivot stop 26 is fixedly attached to the vertical portion 20. The lock 28 is threadedly secured to a threaded end portion 42 of the vertical portion 20. The handle 30 is fixedly attached to the end portion 42 so that when the handle 30 is turned by hand, the nozzle 14 moves with it, thereby to reposition the direction of the discharge opening 16. A rubber washer 44 provides a seal between the vertical portion 20 and the pivot guide 24.

The pivot guide 24 has a stepped end portion 46 with one edge 48 higher than the other edge 50. Vertical shoulders 52 define the junction between the upper edge 48 and lower edge 52. The pivot stop 26 is preferably a sleeve having an upper edge 54 and a stem 56 extending above the upper edge 54. The stem 56 engages one of the shoulders 52 when the nozzle 14 is in one direction and engages the other shoulder 52 when the nozzle 14 is in the opposite direction.

To change the direction of the nozzle 14, the lock 28 is loosened by turning the handle counterclockwise. This action releases the frictional engagement between the edges 48 and 54, allowing the handle 30 to turn the nozzle 14. The handle 30 is then turned to the desired direction until the stem 56 engages the corresponding shoulder 52. The lock 28 is then tightened by turning it clockwise, drawing up the upper edge 54 against the upper edge 48 into frictional engagement, thereby locking the nozzle 14 in place.

In operation, the siphon 2 is connected inline of a hose being used to fill a temporary water storage tank for use, for example, in fighting a fire. A source of pressurized water is connected to the nozzle 14 through the connector 34. The hose is typically used to transfer water from a tanker truck to the storage tank or to draw water from the storage tank to a pumper truck. Generally, the same hose may be used to fill the tank or draw water from the tank. To assist in filling the tank, the discharge opening 16 of the jet nozzle 14 is directed toward the storage tank, thereby assisting the pump in the tanker truck. When water from the storage tank is being fed to a pumper truck, the direction of the discharge opening 16 is reversed to point toward the pumper truck, thereby assisting the pump in the pumper truck. Accordingly, the siphon 2 need not be disconnected from the hose and reconnected in the reverse direction. The lock 28 is simply loosened, the handle 30 is turned to change the direction of the discharge opening 16, and the lock 28 is then tightened. The siphon 2 advantageously remains attached to the hose at all times.

The siphon 2 may also be used when pumping sewage from a holding tank to a transfer tanker truck. The connector 34 is connected to a source of compressed air. The siphon 2 is connected inline of the hose used to connect the tanker truck to the sewage holding tank. To aerate the sewage, the nozzle 14 is directed toward the sewage tank. The sewage maybe aerated to make it more flowably by directing the nozzle 14 toward the holding tank. To pump the sewage out, the direction of the nozzle 14 is reversed to help pump the sewage to the sewage truck. The siphon 2 advantageously boosts the power of the pump in the transfer truck or in the holding tank, especially when the sewage has to be lifted up a substantial distance.

Figure 6:
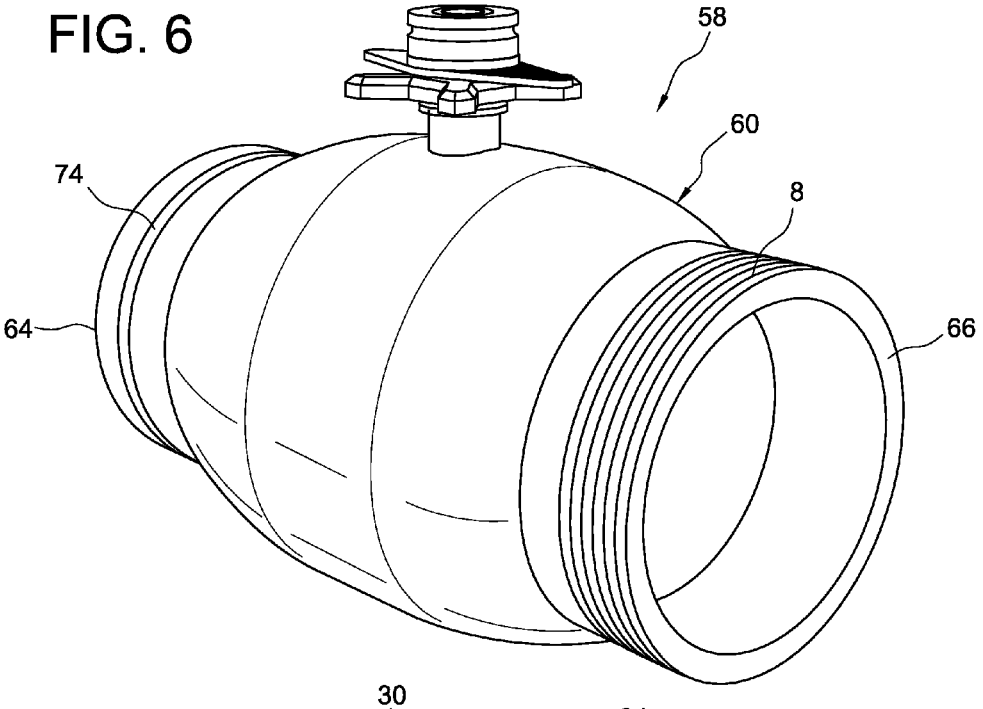
FIG. 6 is a perspective view of another embodiment of an inline jet siphon embodying the present invention.
Figure 7:
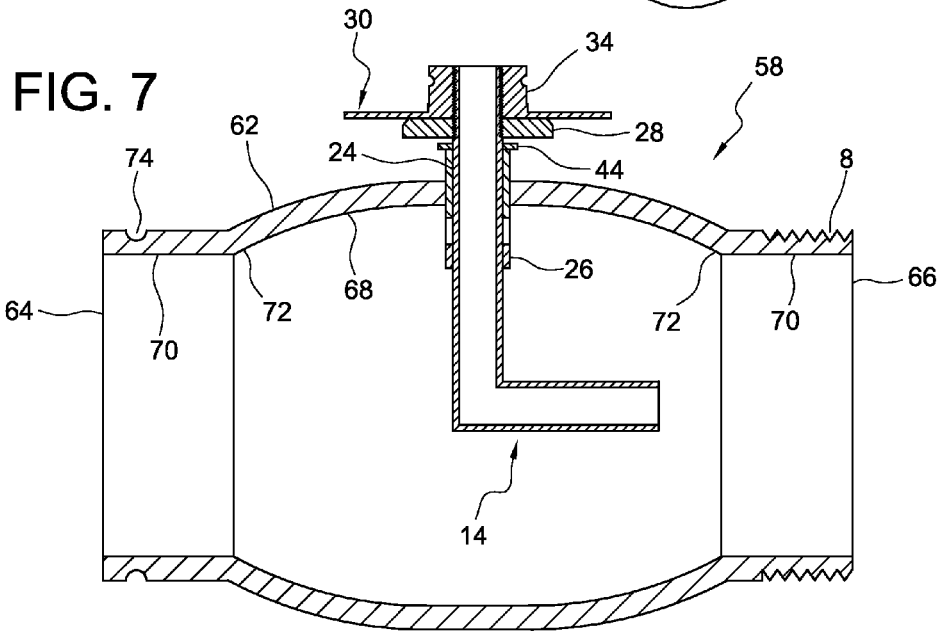
FIG. 7 is a longitudinal cross-sectional view of FIG. 6.

Referring to FIGS. 6 and 7, a siphon 58 is disclosed as another embodiment of the siphon 2. The siphon 58 has a body 60, which is made in one piece. The body 60 has an intermediate portion 62 disposed between one end portion 64 and an opposite end portion 66. The intermediate portion 62 has increasing internal diameter and then a decreasing diameter in a direction from the end portion 64 to the end portion 66. An interior surface 68 of the intermediate portion 62 is advantageously barrel-shaped. The end portions 64 and 66 have interior cylindrical surfaces 70 joined to the interior surface 68 without any protruding shoulders that extend above the adjacent surface at the junctions 72. The interior surface 68 advantageously reduces turbulence within the body 60. In addition, the absence of any protruding shoulders within the body 60 further contributes to the reduction of turbulence in the water flow through the siphon 58. The nozzle 14 is advantageously disposed within the intermediate portion 62.

Circumferential groove 74 is used to attach the swivel 10 to the body 60 in a conventional way. A complementary groove (not shown) in the swivel 10 cooperates with the groove 74 to capture a plurality of ball bearings (not shown) to thereby attach the swivel 10 to the body 60. The swivel 10 has female threads 12 (see FIG. 3) for connection to a hose, for example. Male threads 8 are provided on the end portion 66 for connection to another hose, for example.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. An inline jet siphon, comprising:

a) a hollow body for connecting inline of a hose, said hollow body including a through opening for passing liquid or slurry therethrough, said body including an axis through said through opening;

b) a jet nozzle having a discharge opening disposed within said hollow body, said discharge opening is positionable between toward one direction along said axis and toward an opposite direction along said axis;

c) said jet nozzle is movable to position said discharge opening from toward said one direction along said axis to toward said opposite direction along said axis to reverse direction of flow of the liquid or slurry through said hollow body;

d) a first stop to position said discharge opening toward said one direction along said axis and a second stop to position said discharge opening toward said opposite direction along said axis; and e) said nozzle being limited in movement between said first stop and said second stop.

2. An inline jet siphon as in claim 1, wherein said hollow body includes a tubular portion.

3. An inline jet siphon as in claim 1, wherein:

a) said hollow body includes a first end portion and an opposite second end portion;

b) said first end portion includes male threads; and c) said second end portion includes female threads.

4. An inline jet siphon as in claim 3, wherein:

a) said second end portion includes a swivel; and b) said swivel includes said female threads.

5. An inline jet siphon as in claim 1, wherein:

a) said jet nozzle includes a horizontal portion and a vertical portion;

b) said vertical portion extends through a wall of said hollow body; and c) said vertical portion is pivotal relative to said hollow body.

6. An inline jet siphon as in claim 5, and further comprising:

a) a handle attached to said vertical portion; and b) said handle includes a directional pointer to indicate said one direction or said opposite direction of said discharge opening.

7. An inline jet siphon as in claim 5, and further comprising:

a) a pivot guide attached to said wall;

b) said vertical portion extends through said pivot guide; and c) said vertical portion is pivotable relative to said pivot guide.

8. An inline jet siphon as in claim 7, wherein:

a) said pivot guide includes a stepped edge portion including first and second shoulders disposed apart from each other;

b) said vertical portion includes a stem portion that engages one of said first and second shoulders;

c) said first stop comprises said stem portion engaging said first shoulder; and d) said second stop comprises said stem portion engaging said second shoulder.

9. An inline jet siphon as in claim 8, wherein:

a) said pivot guide is a sleeve member;

b) said stem portion is disposed on a ring having an edge portion; and c) said ring is rotatable with said vertical portion.

10. An inline jet siphon as in claim 1, and further comprising:

a) a handle operably associated with said jet nozzle for moving said discharge opening toward said one direction or said opposite direction; and b) said handle including a direction indicator for said discharge opening of said jet nozzle.

11. An inline jet siphon as in claim 10, wherein:

a) said handle includes a longitudinal axis disposed along said one direction or said opposite direction of said discharge opening; and b) one end of said handle includes a marker to indicate said one direction or said opposite direction of said discharge opening.

12. An inline jet siphon as in claim 1, wherein said hollow body includes a cylindrical intermediate portion.

13. An inline jet siphon as in claim 1, wherein said hollow body includes a barrel-shaped intermediate portion.

14. An inline jet siphon as in claim 13, wherein said hollow body includes cylindrical end portions.

15. An inline jet siphon as in claim 14, wherein said cylindrical end portions include internal cylindrical surfaces that connect with an internal surface of said barrel-shaped intermediate portion without protruding shoulders.

16. An inline jet siphon as in claim 1, wherein:

a) said hollow body includes a first end portion, an opposite second end portion, and an intermediate portion; and b) said intermediate portion has increasing internal diameter and then a decreasing diameter in a direction from said first end portion toward said second end portion.

17. An inline jet siphon as in claim 16, wherein said jet nozzle is disposed within said intermediate portion.

18. An inline jet siphon as in claim 16, wherein:

a) said intermediate portion has a barrel-shaped interior surface; and b) said first and second end portions include interior cylindrical surfaces.

19. An inline jet siphon, comprising:

a) a hollow body for connecting inline of a hose, said hollow body including a through opening for passing liquid or slurry therethrough, said hollow body including an axis through said through opening;

b) a jet nozzle having a discharge opening disposed within said hollow body, said discharge opening is positionable between toward one direction along said axis and toward an opposite direction along said axis;

c) said jet nozzle is movable to position said discharge opening from toward said one direction along said axis to toward said opposite direction along said axis; and d) an indicator to indicate when said discharge opening is positioned toward said one direction along said axis and when said discharge opening is positioned toward said opposite direction along said axis.

20. An inline jet siphon as in claim 19, and further comprising:

a) a handle operably associated with said jet nozzle for moving said discharge opening toward said one direction or said opposite direction; and b) said handle includes said indicator.

21. An inline jet siphon as in claim 20, wherein said indicator is a pointer.

22. An inline jet siphon as in claim 20, wherein an end portion of said handle is marked with a color to indicate said one direction or said opposite direction of said discharge opening.

23. An inline jet siphon as in claim 20, wherein:

a) said handle includes a longitudinal axis disposed along said one direction or said opposite direction of said discharge opening; and b) one end of said handle includes a marker to indicate said one direction or said opposite direction of said discharge opening.

24. An inline jet siphon, comprising:

a) a hollow body for connecting inline of a hose, said hollow body including a through opening for passing liquid or slurry therethrough, said hollow body including an axis through said through opening;

b) a jet nozzle having a discharge opening disposed within said hollow body, said discharge opening is positionable between toward one direction along said axis and toward an opposite direction along said axis;

c) said jet nozzle is movable to position said discharge opening from toward said one direction along said axis to toward said opposite direction along said axis; and d) a lock operably associated with said jet nozzle to fix said discharge opening when said discharge opening is positioned toward said one direction along said axis and when said discharge opening is positioned toward said opposite direction along said axis.

25. An inline jet siphon as in claim 24, and further comprising:

a) pivot guide attached to said wall, said pivot guide includes a bottom edge;

b) said jet nozzle includes a vertical portion extending through said pivot guide, said vertical portion is pivotable relative to said pivot guide;

c) said vertical portion includes a ring having a top edge frictionally engageable with said bottom edge; and d) said lock is configured to draw said bottom edge in frictional engagement against said top edge to fix said discharge opening toward said one direction or said opposite direction.

* * * * *